United States Patent [19]

Moisan et al.

[11] 4,049,940

[45] Sept. 20, 1977

[54] DEVICES AND METHODS OF USING HF WAVES TO ENERGIZE A COLUMN OF GAS ENCLOSED IN AN INSULATING CASING

[75] Inventors: Michel Moisan, Montreal, Canada; Philippe Leprince, Gif-sur-Yvette, France; Claude Beaudry, Laval, Canada; Emile Bloyet, Gif-sur-Yvette, France

[73] Assignee: Agence Nationale de Valorisation de la Recherche (ANVAR), France

[21] Appl. No.: 627,271

[22] Filed: Oct. 30, 1975

[30] Foreign Application Priority Data

Oct. 31, 1974 France ..... 74.36378

[51] Int. Cl.[2] ..... H05G 9/06

[52] U.S. Cl. ..... 219/10.55 R; 219/10.81; 313/231.3

[58] Field of Search ..... 219/121 R, 121 P, 155, 219/10.81; 313/231.3, 231.4; 315/111.5, 111.7, 39.51, 39.3

[56] References Cited

U.S. PATENT DOCUMENTS

| | | | |
|---|---|---|---|
| 3,445,722 | 5/1969 | Scott et al. | 315/111.4 |
| 3,671,195 | 6/1972 | Bersin | 315/111 X |
| 3,780,255 | 12/1973 | Boom | 219/121 P |
| 3,879,597 | 4/1975 | Bersin et al. | 219/121 P |
| 3,886,896 | 6/1975 | Cakenberghe | 313/231.3 |

*Primary Examiner*—Arthur T. Grimley

*Attorney, Agent, or Firm*—Larson, Taylor and Hinds

[57] ABSTRACT

A device which generates plasma by energizing a column of gas with a high frequency periodic electric field of a frequency of at least 100MHz. The generating means extends over only a part of the gas column and the power of the energizing field is such that the plasma generated includes and extends beyond said part of the gas column. In one embodiment the gas column is contained in an elongated insulating casing and the generating means comprises a first metallic tube open at both ends and surrounding a part of the casing, a second tube enclosing the first, and a connecting ring between the first and second tubes.

27 Claims, 15 Drawing Figures

%
100
90
80
70
60
50
40
cm
36
34
32
30
28
26
24
22
20
18
16
14
12
10
8
6
142
143
2
3
4
5
6
7
8
9
10
p (cm)

cm
40
30
20
%
100
75
50
144
145
10
Ps
20
30
40
50
Watts

DEVICES AND METHODS OF USING HF WAVES TO ENERGIZE A COLUMN OF GAS ENCLOSED IN AN INSULATING CASING

The invention relates to a device for a method of using periodic waves, the frequency of which is in the so-called hyperfrequency (HF) or microwave range to energise a column of gas enclosed in a casing of elongated form. It relates more particularly to a device adapted to create a column of plasma enclosed in a casing made from insulating material such as glass, the excitation energy taking the form of an HF signal.

In a known device of this type described for example in the article by R. M. FREDERICKS et al in the magazine "Journal of Applied Physics", volume 42, No. 9, August 1971, pages 3647 to 3649, the plasma generator comprises a resonant cavity. In this device, the plasma created remains confined within a zone of small length. In other words, this known device makes it possible, by HF excitation, to generate only a short length plasma, of a length at most equal to the length of the energising structure.

However, it is known that, by diffusion, an axial magnetic field makes it possible to increase the length of the plasma created. However, in this case, the length of the plasma is limited by the length of the means which make it possible to generate the above-mentioned magnetic field. Furthermore, the magnetic field generating means are generally heavy and bulky.

The object of the invention is to remedy the above-mentioned disadvantages. Therefore, its object is to provide an HF ionising device which makes it possible to obtain a column of plasma of considerable length.

Another object of the invention is to provide such an HF ionising device which makes it possible to obtain a column of plasma of considerable length for relatively wide ranges of gas pressures in the column and relatively wide ranges of frequency of the excitation source.

It likewise has as object the provision of such an energising device in which the adjustments needed are easily performed.

Yet a further object of the invention is to provide a device for the HF excitation of a plasma column which is of small bulk.

Finally, the invention has as object the simple and economical construction of an energising device of the above-mentioned type.

The device according to the invention in particular comprises means for generating A H F electrical field comprising a plasma energising structure disposed over a part of the length of the elongated casing. Th power of the electrical field provided by the means for generating a H F electrical field in the column of gas is sufficient that (even in the absence of a magnetic field) a plasma is generated over a length which is substantially greater than the said part of the length on which the energising structure is disposed. In other words the length of the plasma comprises the said part of the length of the elongated casing and an additional length which follows on from the said length.

Indeed, the inventors have found that when the power of the HF electrical field provided by generator means and imparted to the gas column exceeds a certain threshold, the length thereof increased abruptly. The value of the power threshold depends on a considerable number of parameters, particularly the form and dimensions of the energising structure, the form and dimensions of the insulating casing, the frequency of the HF electrical field furnished by the said generator means and the nature and pressure of the gas contained in the insulating casing. However, this threshold power may be empirically determined.

In the energising device according to the invention, it is advantageous for the said energising structure to comprise means for generating a surface wave in the column of gas. Preferably, this surface wave exhibits azimuthal symmetry with respect to the longitudinal axis of the casing. The term surface wave is intended to denote an electromagnetic wave of which the electrical field has a maximum value at the periphery of the column.

In this case, the inventors have shown that the sudden increase in the length of the plasma column was due to the propagation of the surface wave of which the electrical field ionises the gas.

The creation of a surface wave (or volume wave) corresponds indeed to the above-mentioned characteristics whereby it is necessary for the power furnished to exceed a threshold level. Indeed, for a surface (or volume) wave to be able to be propagated in a column of plasma it is necessary it will be seen hereinafter for the quantity of electrons, that is to say the power provided, to exceed a certain threshold which depends particularly on the frequency of the electrical HF energising field.

In a first embodiment of the invention, the energising structure comprises means for generating an electrical field of transverse direction with respect to the elongated casing and means for orientating the electrical field, adapted to produce from the transverse electrical field and at the periphery of the column an electrical field of a longitudinal direction with respect to the insulating casing. In this case, it is advantageous for the transverse electrical field generating means to comprise a metal plate disposed facing the casing and, preferably in this case, for the means of orientating the electrical field to comprise a metallic structure or enclosure comprising a first tube which is open at both ends and which is adapted to receive the said part of the casing length a second tube enclosing the first and a connecting crown between the first ends of the first and second tubes, the second end of the second tube being closed by a transverse wall in which there is an aperture adapted to allow passage for the said casing, a gap separating the second end of the first tube from the transverse wall, the above-mentioned metallic plate then being disposed so that it faces the first tube in the space separating th first and second tubes, the said supply means being adapted to carry the HF signal to the said metallic plate.

In the last case mentioned above, the device according to the invention advantageously comprises first adjusting or regulating means adapted to move the metal plate in the space separating the first and the second tubes so that its radical position, that is to say the distance separating the plate from the first tube, can be varied.

In a second form of embodiment of the invention the energising structure comprises wave guide means.

Further objects, advantages and dispositions of the invention will become more clearly manifest from reading the description of certain of its forms of embodiment this description being given with reference to the attached drawings, in which:

FIG. 1 diagrammatically shows a first form of embodiment of the ionising device according to the invention.

Figure 1:
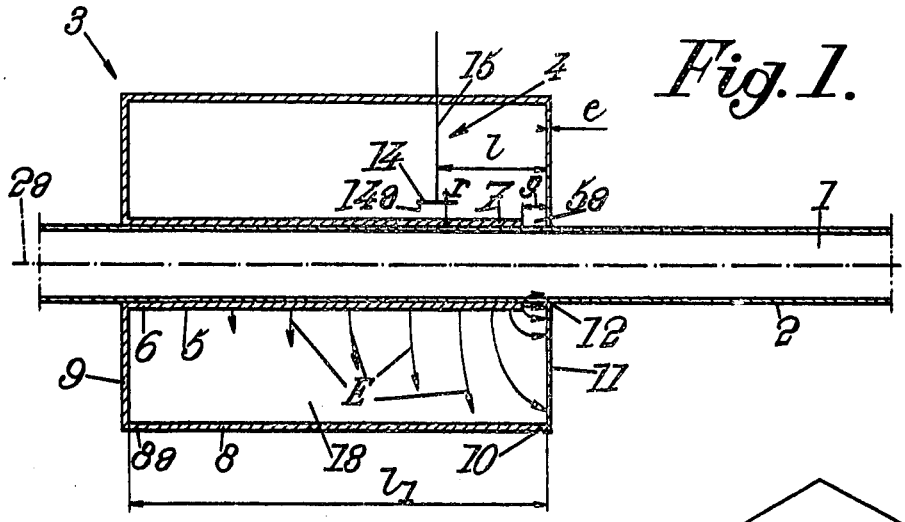
Figure 2:
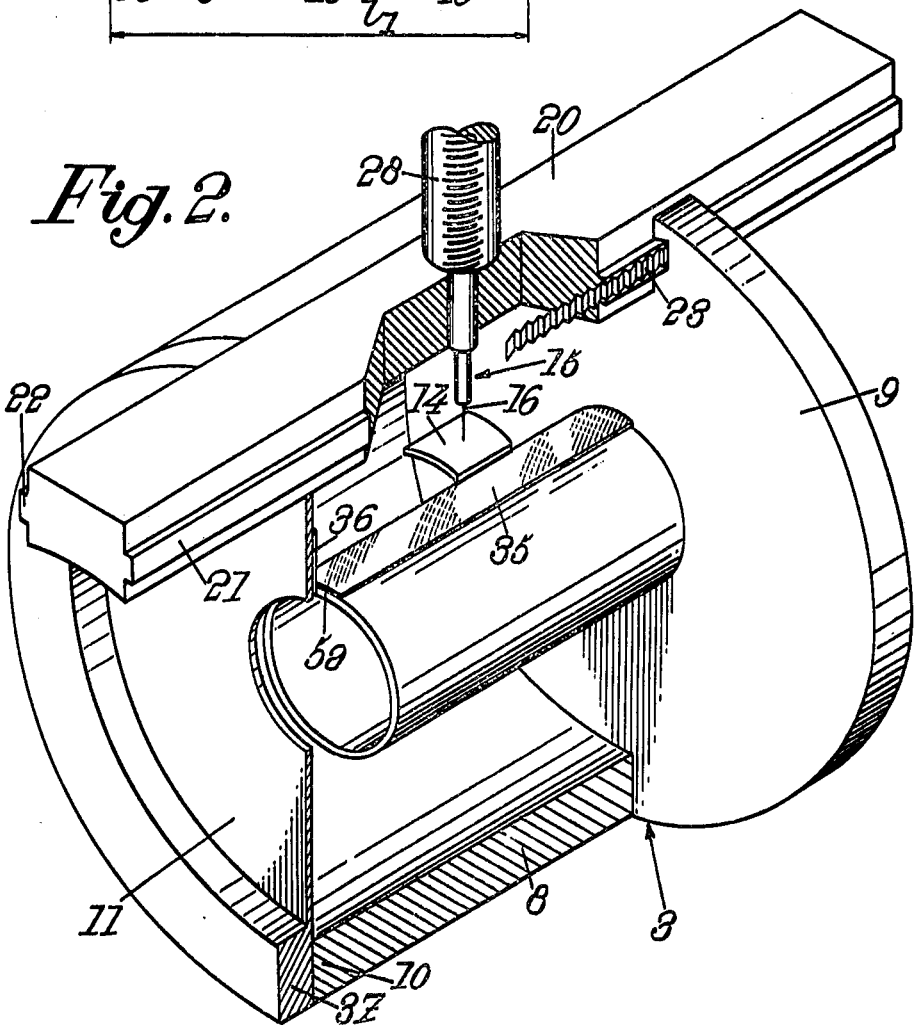
FIG. 2 shows in partially sectional and in simplified perspective an embodiment of the device shown in FIG. 1.
Figure 5:
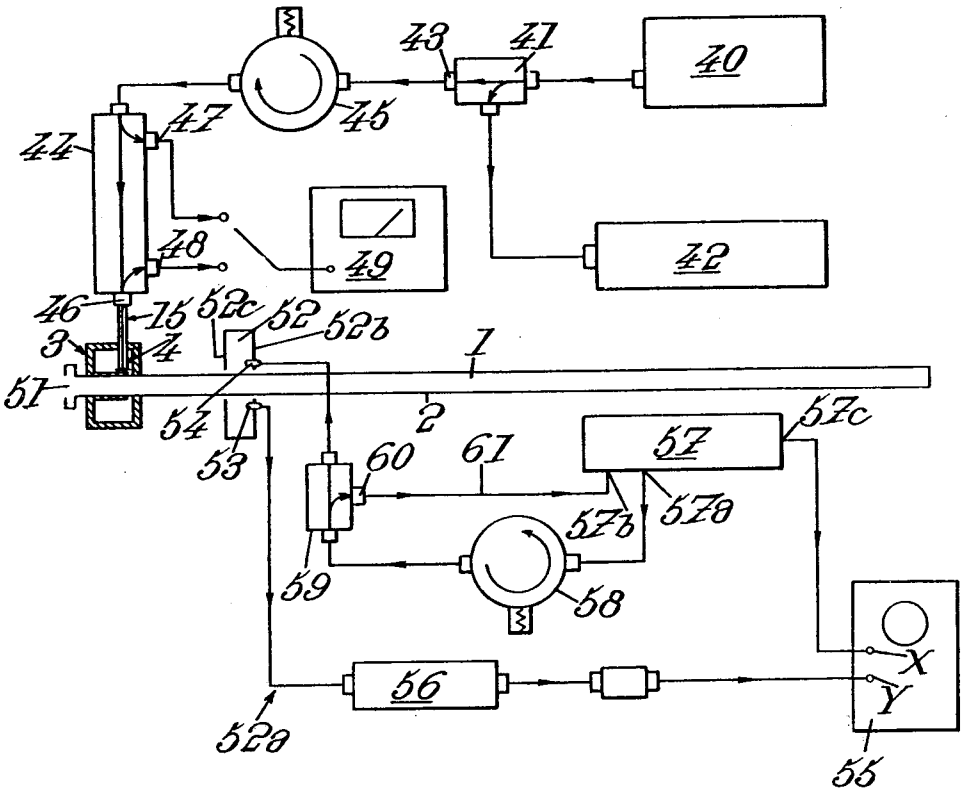
Figure 3:
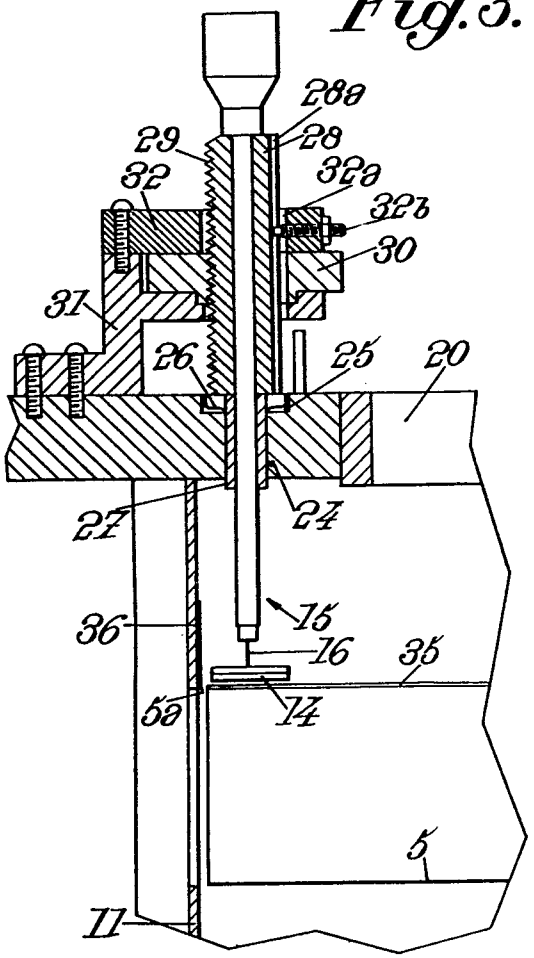
FIG. 3 shows a section taken on a plane passing through the axis of the gas column, of adjusting means which can be used in the device illustrated in FIG. 2.
Figure 4:
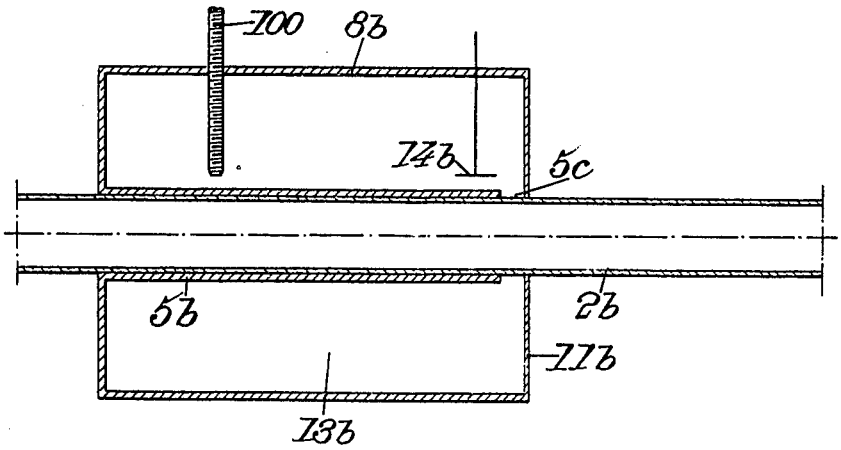
Figure 12:
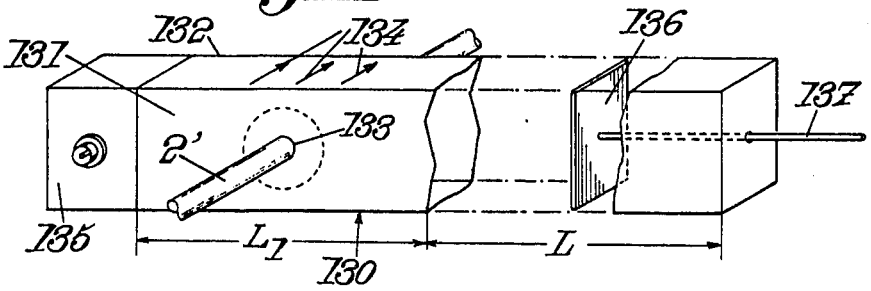
Figure 13:
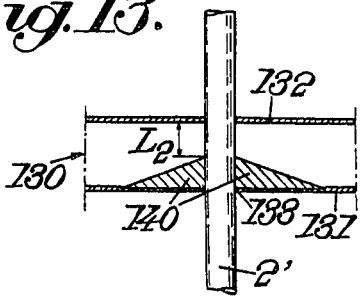
Figure 6:
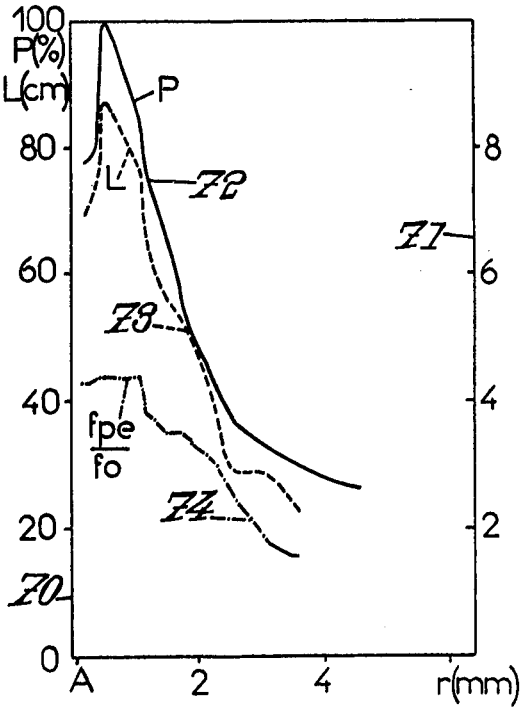
Figure 7:
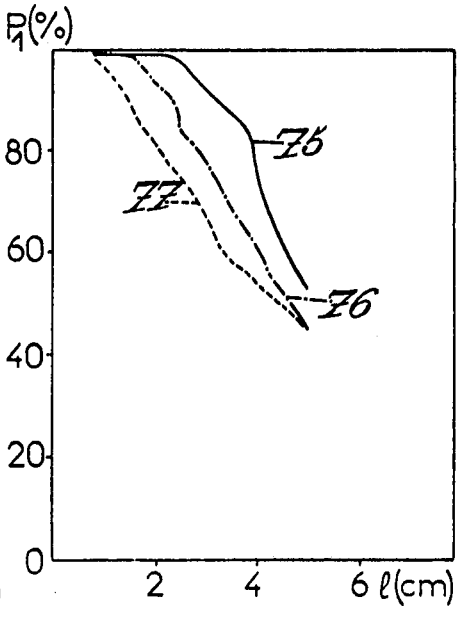
Figure 8:
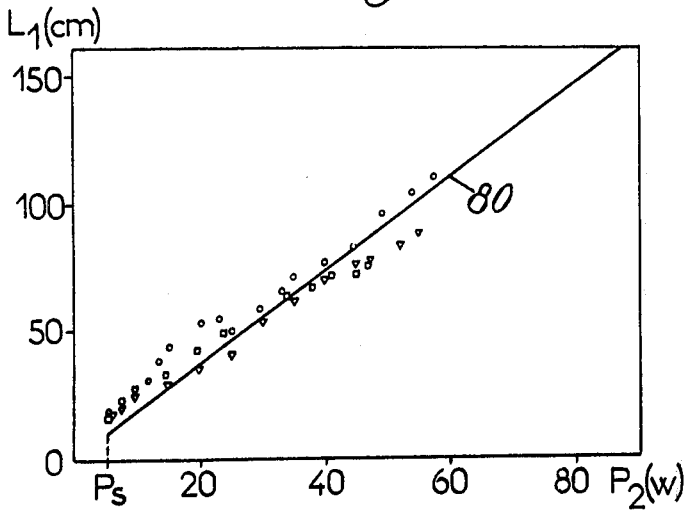
Figure 9:
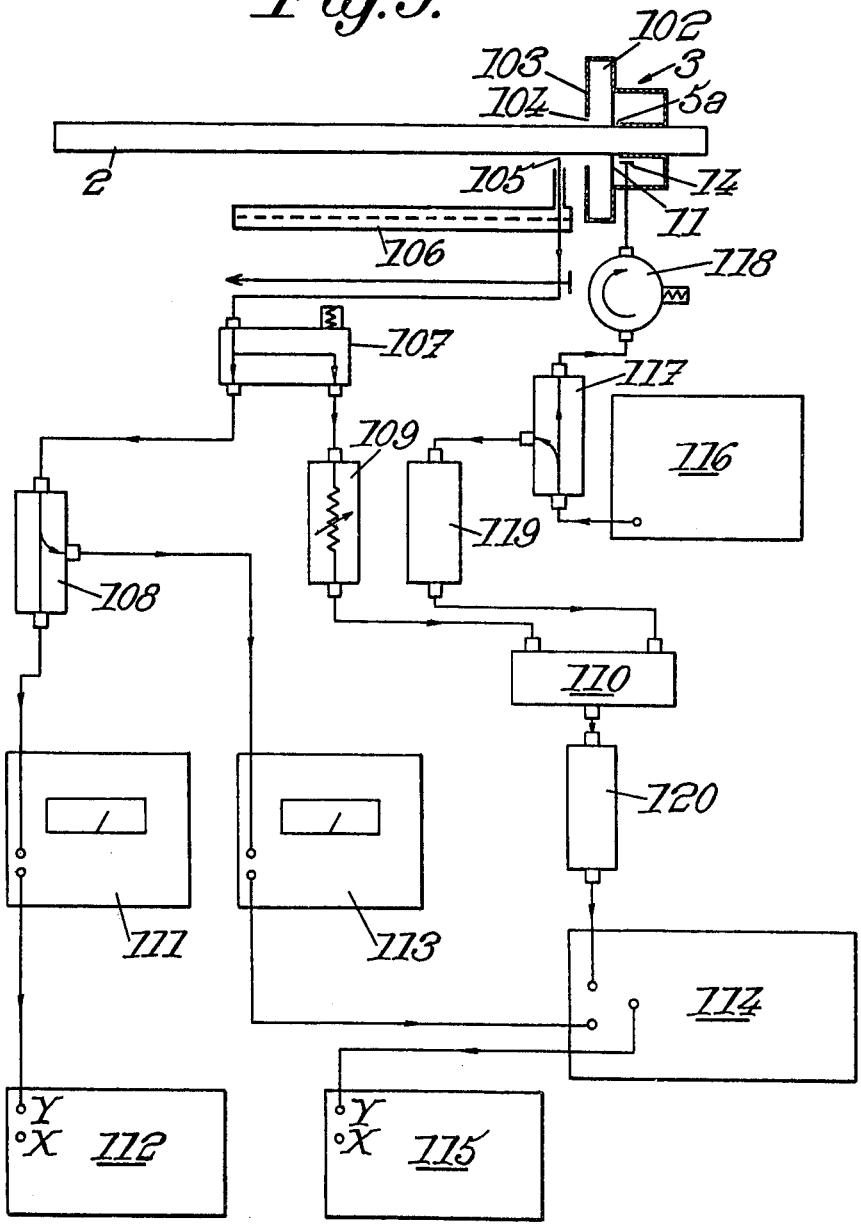
Figure 11:
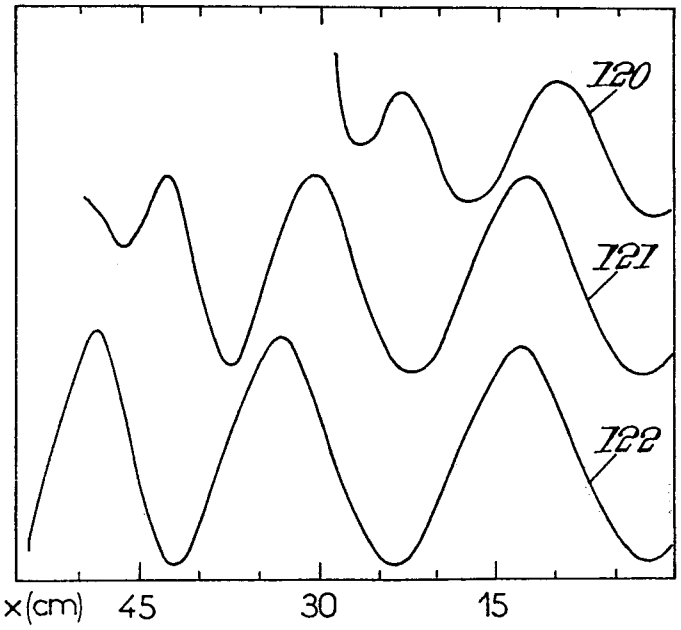
Figure 10:
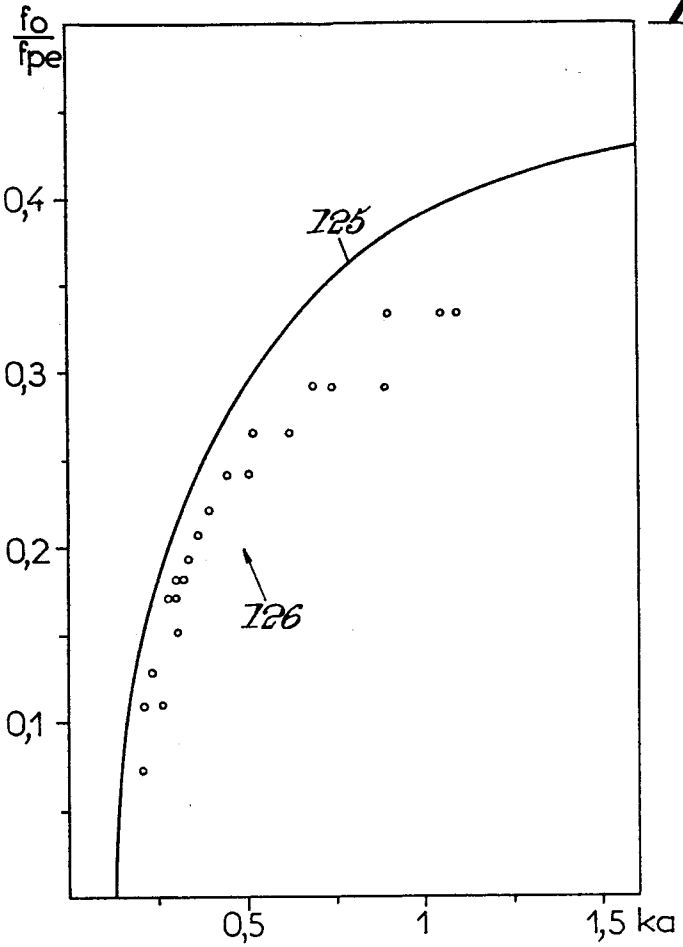
Figure 14:
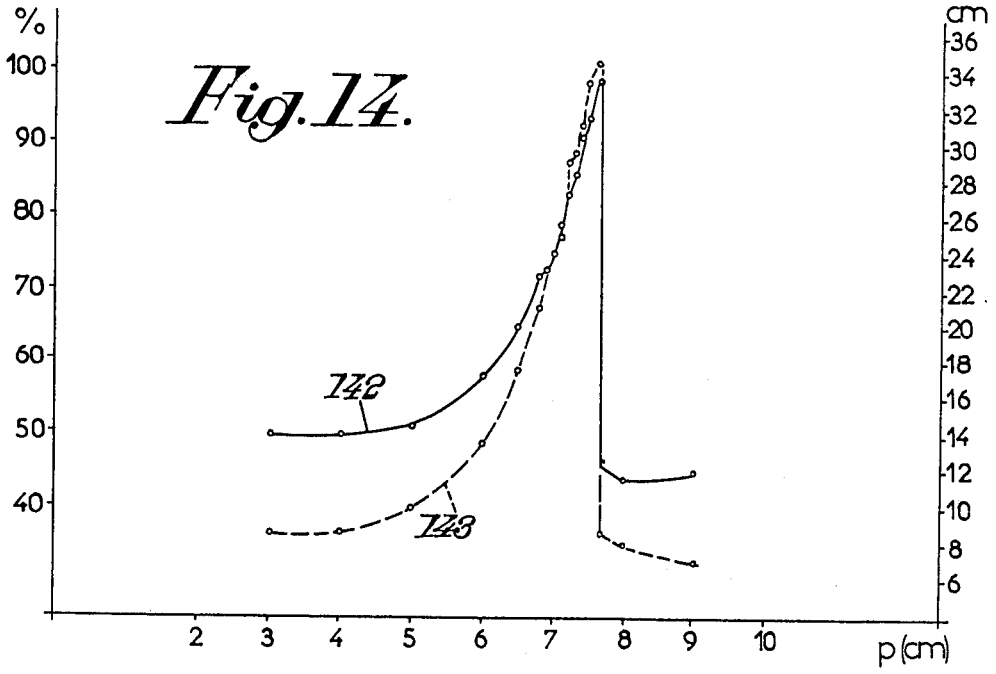
Figure 15:
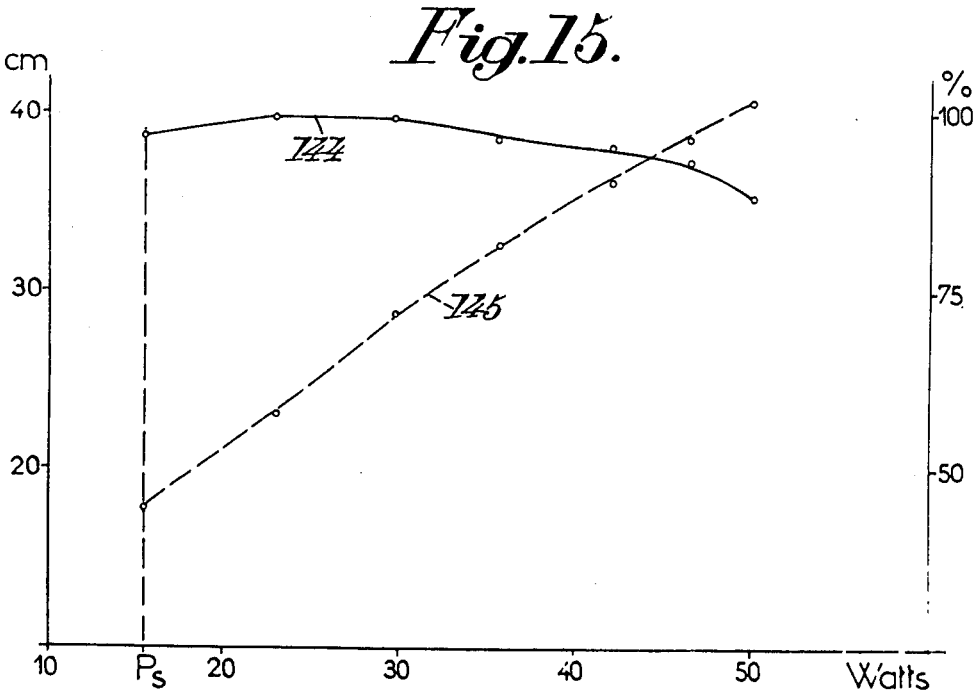

FIG. 4 diagrammatically shows an alternative form of embodiment according to the invention, of the energising device shown in FIGS. 1 and 2;

FIG. 5 diagrammatically illustrates the device according to the invention with an HF generator as well as means of measuring certain properties of the plasma obtained by virtue of the device shown in FIGS. 1 to 3;

FIG. 6 is a diagram illustrating the effect of the adjusting means of the device as illustrated in FIG. 3;

FIG. 7 is a diagram showing the effect of second adjusting means of the device shown in FIG. 2;

FIG. 8 is a diagram showing certain properties of the plasma obtained with a device of the type shown in FIGS. 1 to 4;

FIG. 9 likewise shows diagrammatically a device according to the invention and of the type shown in FIG. 1, with an HF generator and a measuring assembly which makes it possible to reveal certain properties of the plasma obtained; particularly the propagation of surface waves;

FIGS. 10 and 11 are diagrams obtained with the assembly shown in FIG. 9 and which make it possible to show that surface waves are obtained in the plasma created by reason of the device of the type shown in FIGS. 1 to 4;

FIG. 12 diagrammatically shows another form of embodiment of the energising device according to the invention;

FIG. 13 shows a partial section through FIG. 12 taken on the axis of the insulation casing;

FIG. 14 is a diagram showing the effect of the position of the piston of the device shown in FIG. 12, and FIG. 15 is a diagram showing certain properties of the plasma obtained with the device shown in FIG. 12.

The gas ionising device which has been shown in FIGS. 1 to 3 is intended for ionising a gas contained in a cylindrical column or tube 2 made from a dielectric (insulating) material which in the example illustrated is glass. In this embodiment, the gas 1 is argon.

The device according to the invention which is shown in FIG. 1 comprises two main parts, viz. a metal enclosure 3 which takes the form of a coaxial structure, and a coupling means 4.

First of all, the coaxial structure 3 comprises a central tube 5 open at both ends 6 and 7. This tube 5 is intended to contain the column 2. In the example, its inside diameter is therefore slightly larger than the outside diameter of this column.

The structure 3 likewise comprises a second metal tube 8 which surrounds the tube 5 and is on the same axis as this latter and therefore the same axis as the column 2. The first end 8*a* of the tube 8 ends at the same level — along the axis 2*a* of the column 2 — as the tube 5. The ends 8*a* and 6 are connected one to the other by a metal ring 9.

On the other hand, the second end 10 of the tube 8 projects along the axis 2*a* beyond the second end 7 of the tube 5. This second end 10 is closed by a transverse metal wall 11 in which there is a central aperture 12 intended to allow passage of the column 2.

The end 7 of the tube 5 is therefore, in a longitudinal (or axial) direction, separated from the wall 11 by a gap 5*a* of length g (FIG. 1).

The coupling element 4 substantially comprises a metal plate 14 disposed in the space 13 separating the tube 5 and 8, preferably in the vicinity of the gap 5*a* and close to the said tube 5.

The energising device likewise comprises supply means adapted to furnish an HF energising signal to the metal plate 14. Here, these supply means comprise a coaxial cable 15 of which one of the wires, the central wire, is connected to the plate 14 while the other wire is connected as will be seen in connection with FIG. 2, to the metal tube 8.

In the foregoing and hereinfafter the term "hyperfrequencies (HF)" will be used to denote those frequencies which are at least equal to 100 Megahertz.

In the example the metal plate 14 takes the form of a segment of a cylinder of the same axis and of the same diameter as the column 2.

The ionising device shown in FIG. 1 functions in the following way.

The coupling element 4 creates inside the coaxial structure 3 an electrical field the sense and direction of which are illustrated by the arrows E in the space 13. At (in the axial direction) the level of the plate 14, the electrical field created is of a substantially radial direction (at right-angles to the surface of the plate 14) that is to say cross-wise with respect to the axis of the casing 2. In the vicinity of the gap 5*a* of width g, the direction of the electrical field curves in order, in this gap, to assume an axial direction, that is to say lengthwise with respect to the axis 2*a*. Indeed, the electrical field is at right-angles to the plane of the metal plate 11, the thickness of which is minimal as will be seen hereinafter. In the vicinity of the ring 9, the electrical field is of virtually nil value for this ring of considerable thickness forms a short circuit. Thus, the electrical field produced inside the cylindrical column 2 has an axial direction that is to say parallel with the axis 2*a*.

The inventors have found that if the power of the HF source (not shown in FIG. 1) flowing through the coaxial cable 15 was adequate, that is to say exceeded a certain threshold value, then by using the device shown in FIG. 1 it is possible to create a plasma which does not remain confined in the column 2 at the level of the gap 5*a* but which in contrast is of substantially greater length. Experiments have made it possible to reveal this characteristic feature and they will be described hereinafter.

As will be seen subsequently, also the electrical field produced in the column 1 has a higher value at the periphery than it does at the centre of this column. In other words, in the column 1 oscillations are generated which are referred to as surface waves.

Finally, the inventors have found that the electrical field is uniform around the axis of the cylinder 2, in other words its configuration in the space 13 is azimuthal. More precisely, a unique mode of azimuthal wave number is generated : $m = 0$.

As considered under another point of view the operation of the device shown in FIG. 1 may be explained as follows:

If the power imparted to the element 4 is adequate, the electrical field produced inside the column of gas 1 will be of sufficient value to ionise this gas, that is to say to create a plasma. Now surface waves may be propagated in such a column of plasma. With an ionising device according to the invention, therefore, it is possible to create a plasma which is maintained by reason of the surface wave produced by the structure 3; indeed, this wave may be propagated and thus (as the inventors have succeeded in showing) it likewise propagates the ionisation.

It is necessary however to note that the surface waves can be propagated in a plasma only if the frequency $f_o$ of these waves is at most equal to the quantity $f_{pe}/\sqrt{1+\epsilon_g}$ in which formula $\epsilon_g$ represents the relative permittivity of the dielectric material constituting the cylindrical column 2 and $f_{pe} = 1/2\pi \sqrt{ne^2/m\epsilon_o}$, in which latter equation $f_{pe}$ is the frequency of the plastma electrons; $n$ is the density of the electrons, $e$ the elementary charge of the electron, $m$ the mass of the electron and $\epsilon_o$ the permittivity of the vacuum. The quantiy $n$ is directly related to the power furnished to the column of gas; it can be seen therefore tht it is indeed necessary for the power furnished to exceed a certain threshold in view of the fact that the frequency of the electrons of the plasma $f_{pe}$ must exceed a threshold $(f_{pe})_s = f_o\sqrt{1+\epsilon_g}$.

During the course of experiments conducted within the framework of the invention, the inventors have found that the transfer of power between the coupling element 4 and the column of gas 4 varies as a function of the position of the metal plate 14 in the space 13. For the reason, it is particularly advantageous to provide means which make it possible to vary the position of the said metal plate 14 inside the space 13 located between the tubes 5 and 8 of the structure 3. Such means will be described in connection with FIGS. 2 and 3.

In this embodiment, the coaxial cable 15 is a rigid cable so that the position of the metal plate 14 may be accurately determined.

In the embodiment shown in FIG. 2, in order to allow the axial diaplacement of the metal plate 14, the said coaxial cable 15 is rigid with a slide 20 which forms part of the outer tube 8 of the assembly 3. In the example, the slide 20 projects on either side in the axial direction of the walls 9 and 11. The slide 20 is made from a metal which is in this case aluminium while the rest of the assembly 3 is made from brass. In the embodiment shown in FIG. 3, the slide 20 which is of elongated form has on each of its longer sides ribs respectively 21 and 22. These ribs are intended to co-operate with grooves provided on the corresponding portions of the tube 8 and the walls 9 and 11. In order to ensure satisfactory electrical contact between the slide 20 and the elements with which it must be contact (walls 9 and 11 of the outer tube 8), contact springs 23 are provided which are located in the bottom of the grooves which have to co-operate with the ribs 21 and 22.

The rigid coaxial cable 15 extends beyond the outside of the tube 8 so that it can be connected to generator means providing the necessary HF signal. For this reason, the slide 20 has in it an aperture 24 (FIG. 3) to allow passage of the said cable 15. Moreover, as will be seen hereinafter (FIG. 3), means are provided to cause the cable 15 to slide in the said aperture in such a way that the radial position of the plate 14 can vary.

As can be seen from FIG. 3, the part of the aperture 24 which is adjacent the outer surface of the slide 20 is of a larger diameter. Disposed in this part 25 is a spring 26 which ensures permanent contact whatever the radial position of the cable 15, between the outer conductor 27 of this cable and the slide 20. With regard to this, it will be noted that the central conductor 16 of the cable 15 is welded to the plate 14.

The said FIG. 3 likewise shown means for fixing the cable 15 to the slide 20 and the means for radial displacement of this cable.

These radial displacement means for the cable 15 and thus for the plate 14 comprise first of all a sleeve 28 disposed around the upper part of the cable 15. This sleeve 28 has a screw-threading 29 on a part of its periphery. This screw-threading 29 co-operates with a regulating nut 30 of a position which, in radial and axial directions, is fixed with respect to the slide 20. For this purpose, the nut 30 rests on a support 31 fixed to the slide 20 and the top part of the said nut 30 is surmounted by a plate 32 having an aperture **32*a*, this plate being rigid with the support 31. A screw 32*b* rigid with the plate 32 co-operates with a groove 28*a* in the sleeve 28 to prevent rotation of this sleeve 28, and therefore of the cable 15, about its axis when the nut 30 is driven with a rotary movement. Thus, it is possible indeed to regulate the radial position of the plate 14**; this adjustment is true and functions smoothly. Moreover, the said adjustment can be very precise if vernier means are used.

As will be seen hereinafter it connection with FIG. 6, the optimum radial position of the plate 14 is in the vicinity of the periphery of the inner tube 5 of the assembly 3. In order to make it possible to bring the metal plate 14 as close as possible to the tube 5 with no risk of breakdown, particularly when a considerable power is applied, the said tube 5 is covered with a film 35 (FIG. 2) of an insulating material which in the example illustrated is mica. In the embodimdent shown in FIG. 2, the film 35 takes the form of a strip occupying the entire length of the tube 5 parallel with the axis of this tube and over a fraction of its periphery. It is sufficient for this band 35 to be normally facing the plate 14.

Still in order to avoid breakdowns when the plate 14 is located in proximity of the tube 5 as an alternative (not shown), an insulating film is provided on that face of this plate 14 which is normally facing the tube 5.

It will likewise be seen hereinafter that the optimum axial position of the plate 14 corresponds to a small distance from the wall 11. For the reason set out hereinabove (risk of breakdown), therefore, the part of the wall 11 which is close to the gap **5*a* is covered with a layer 36 of mica (or generally of an insulating material). Alternatively, it is the portion of the plate 14 which is facing the wall 11** which is covered with an insulant.

Finally, with regard to the device shown in FIG. 2, it should be noted that the wall 11, advantageously thin, forms a ring made all in one piece with a ring 37 of greater thickness this ring being fixed to the portion of the end 10 of the outer tube 8 of the assembly 3.

The inventors have likewise found that the transfer of power between the coupling element 4 and the column of gas 1 may likewise be varied by means of an adapting element which may replace the slide 20 (FIG. 2). Such a construction in which an adapting element is provided is shown diagrammatically in FIG. 4.

The assembly shown in FIG. 4 differs from that shown in FIGS. 1 and 2 on the one hand by reason of the fact that the outer cylinder **8*b* does not comprise any slide and, on the other, by reason of the fact that no means are provided for axial displacement of the metal plate 14*b*. In this embodiment, the adapting element 100 is constituted by an elongated metallic conductor disposed radially with respect to the column of glass 2*b*. This adapting element 100 comprises a screw-threading co-operating with a tapped hole provided in the outer tube 8b in such a way as to vary the penetration of this element 100 into the space 13b between the tubes 5b and 8b. In the example illustrated in FIG. 4, the plate 14b is disposed in an axial direction in the vicinity of the gap 5c between the end of the tube 5b and the wall 11** *b*. In this case, there are likewise provided means for radial displacement of the metallic plate 14b.

FIG. 5 shows an example of assembly adapted to supply the coupling element 4 in such a way as to energise ionisation of the gas 1 contained in the glass tube 2. This FIG. 5 likewise shows an assembly for the measurement of parameters of the signal furnished to the energising device and an assembly for measuring one of the characteristic features of the plasma obtained with the energising device of the type described in connection with FIGS. 1 to 4.

The said supply assembly comprises first of all an HF generator 40, the output of which is connected to the input of a first directive coupler 41. The object of this coupler 41 is to draw of a small fraction of the input power and direct it at a frequency meter 42. In the example, this fraction of energy which is drawn off and directed to the frequency meter 42 corresponds to an attenuation of − 30 decibels (dB). The main output 43 of the couler 41 is connected to the input of a bi-directional coupler 44 through an isolater 45. It is the main outlet 46 of the coupler 44 which is connected to the coaxial cable 15. The first tapping output 47 of the coupler 44 delivers a signal to indicate the incident power furnished to the coaxial cable 15. In the example the attenuation of the signal provided via the outlet 47 has a value of − 20 dB. The second tapping outlet 48 of the coupler 44 supplies a signal representing the power reflected by the device 4. A bolometer 49 may be connected either to the outlet 47 or to the outlet 48 and therefore makes it possible to measure the said incident and reflected powers. With the bolometer 49, therefore, it is possible to measure the power absorbed by the assembly consisting of the plasma and the energising device according to the invention.

In the example shown in FIG. 5, the assembly 3 is disposed in the vicinity of the pumping end 51 of the tube 2. In the example, this tube 2 is 1.20 metres long.

At approx. 15 cm from the structure 3, that is to say from the plasma source, there is a cavity 52 connected to a measuring assembly 52a. In per se known manner, the cavity 52 and the assembly 52a are intended to determine the electronic density of the plasma disposed in the tube 2; for this purpose, the frequency displacement of the resonance peak of the mode $TM_{010}$ of the cavity 52 is measured. It should be noted that the webs 52b and 52c of this cavity 52 are thin (their thickness being of the order of 0.5 mm in the example) in order to avoid excessive attenuation of the electrical field of the above-mentioned surface wave. The diameter of the apertures provided in this cavity to allow passage for the tube 2 is greater than the diameter of the said tube by approximately 2 cm.

For connection to the assembly 52a, the cavity 52 has an outlet 53 and an inlet 54. The outlet 53 is connected to the inlet Y of an oscilloscope 55 through a band-pass filter 56 and a crystal. The inlet 54 of the cavity 52 is connected to the first outlet 57a of a sweep oscillator 57 for generating HF signals through an isolator 58 and a directive coupler 59. The tapping outlet 60 of the coupler 59 is connected to the inlet 57b of the generator 57. The generator 57 comprises a second outlet 57c connected to the inlet X of the oscilloscope 55.

The connection 61 between the outlet 60 of the coupler 59 and the inlet 57b of the generator 57 has the purpose of levelling (or regulating) the signal furnished by this generator 57.

It should be noted here that the measuring device with the cavity 52 and assembly 52a can be used only when the plasma pressure does not exceed a few hundreds of millitorrs. However, the invention est not limited to these pressure levels.

FIGS. 6 and 7 show the effects of the adjustment of the position of the plate 14 of the device which has been described in conjunction with FIGS. 1 to 3. The diagrams shown in these drawings correspond to experiments carried out in order to perfect the invention.

FIG. 6 is a diagram showing, on the abscissa, the radial position *r*, expressed in millimetres, of the said plate 14. This radial position *r* is the distance separating on the one hand the face 14a of the plate 14 which is normally facing the tube 5 and on the other hand the periphery of the said tube 5 (FIG. 1). The graduations shown on the ordinates 70 correspond to the power P absorbed by the plasma and the energising device, the units being expressed as a percentage % of the power supplied. These same graduations on the ordinates 70 correspond likewise to the length L of the plasma created, this length L being expressed in cm. The line of ordinates 71 shown on the right in the diagram in FIG. 5 corresponds to the ratio $f_{pe}/f_o$, $f_{pe}$ representing the frequency of the plasma electrons and $f_o$ the frequency of the incident wave or energising frequency.

In the said FIG. 6, the curve 72 shown in solid line represents the variations in power P as a function of the radial position r of the plate 14. The curve 73 in the broken lines shows the variations of the length L of the plasma obtained as a function or r. Finally the dash-dotted curve 74 illustrates the varitions in the ratio $f_{pe}/f_o$. As already mentioned, these curves are the result of experiments conducted within the scope of the invention. For these experiments the gas 1 used was argon under a pressure of 40 millitorrs the incident power furnished was 40 watts, the frequency $f_o$ of the signal furnished was 460 Megahertz, the glass tube 2 (relative permittivity $\epsilon g = 4.5$) had an inside diameter of 25.4 mm and an outside diameter of 29.8 mm, the plate 14 had substantially the shape of a square measuring 1.27 cm by 1.27 cm, the thickness e (FIG. 1) of the wall 11 was 0.5 mm and the width *g* of the gap 5a was 2 mm.

With regard to the conditions of the experiment which led to the results shown in FIG. 6, it will be noted that the metal plate 14 was in an optimum axial position, that is to say, as will be seen in conjunction with FIG. 7, close to the gap 5a.

It will be seen in FIG. 6 that the effect of the regulation of the radial position of the plate 14 is quite substantial. Over a gap of minimal length, less than 3 mm, the absorbed power P varies from 30 to 100%, the frequency $f_{pe}$ of the plasma electrons varying by a factor two and the length of the created plasma varying for its part by a factor three.

The optimum radial position corresponds to a separation from the outer surface of the inner tube 5 amounting to a few tenths of a millimetre.

Finally, the point A on the axis of the abscissa of the diagram in FIG. 6 corresponds to the thickness of the insulating layer 35.

Shown on the abscissa in FIG. 7 is the axial position $l$ expressed in cm, of the metal plate 14. This length $l$ corresponds to the distance separating the wall 11 from the axis of the plate 14. Shown in the ordinates is the power $P_1$ $l$ absorbed by the assembly constituted by the plasma and the energising device according to the invention, this power $P_1$ is expressed as a percentage % of the incident power.

The curves appearing in FIG. 7 are traced under the following experimental conditions. The gas 1 used was argon under a pressure of 150 millitorrs; the signal furnished to the energising device had a frequency of 460 Megahertz and a power of 30 watts. As in the case of the experiments which results in the diagram in FIG. 6, the metal plate 14 was in the shape of a square measuring 1.27 cm by 1.27 cm and the tube 2 has an inside diameter of 25.4 mm and an outside diameter of 29.8 mm.

The solid line graph 75 illustrates the variations in power $P_1$ as a function of the axial position of the plate 14 when the thickness e of the wall 11 has the value 1 mm. The curve 76 in mixed lines illustrates the variations in the power $P_1$ when the thickness $e$ is 3 mm and the graph 77 in broken lines illustrates the variations in the said power $P_1$ when the thickness $e$ is 4.76 mm.

Examination of the curves 75, 76 and 77 in FIG. 7 shows that the optimum axial position of the plate 14 corresponds to the shortest distance between this plate and the gap 5a. However, the plate 14 must not cover the said gap 5a. Furthermore, regulation of the optimum axial position of the plate 14 is increasingly easier as the wall 11 becomes thinner. Indeed, as the curve 75 in FIG. 7 shows, over a length of approx. 2 cm the power $P_1$ absorbed by the plasma and the energising element according to the invention is virtually 100%. The experiments conducted within the framework of the invention have shown that for a thickness $e$ of 0.5 mm, the absorbed power $P_1$ retained the value 100% for a length $l$ which was even greater. In any event, it is preferably to give the smallest possible value to the thickness e.

Still with regard to the axial position of the plate 14, it should be noted that the density of the electrons in the plasma increases as the plate 14 is brought closer to the gap 5a. This density increases if the thickness $e$ of the wall 11 is diminished. In other words, the frequency $f_{pe}$ of the plasma electrons increases when the plate 14 draws close to the gap 5a and whem the thickness $e$ diminishes.

To sum up, adjustment of the axial position of the plate 14 affects above all the value of the frequency of the plasma electrons while the regulation of the radial position of the said plate 14 affects above all the absorbed by the plasma.

With regard to the parameters of construction and operation of the device shown in FIGS. 1 to 4, other than the position of the plate 14 (and possibly the position of the element 100) and the thickness e of the wall 11, it should be noted that the width g of the gap 5a is preferably of the order of 2 mm. The length $l_1$ (FIG. 1) of the tube 8 is preferably at least equal to 5 cm. However, the length $l_1$ may be less; it is sufficient to comment that in this case the absorbed power retains adequate value only for a narrow range of values of the frequency $f_o$ of the energising signal. Furthermore, if this length $l_1$ is less than 5 cm the length of the plasma obtained and the density thereof will be small.

The inside diameter of the tube 2 may be comprised within a wide range of values. During the course of the experiments conducted within the framework of the invention the inventors used tubes of various diameters, the smallest of which was 1 mm and the largest 50 mm. Furthermore, the inventors found that the smaller the cross-section of the plasma, the greater was the density of the electrons (for one and the same absorbed HF energy). During the course of said experiments, they obtained $10^{13}$ electrons per cu.cm with a tube 2 of 2 mm diameter.

The pressure of the gas to be ionised is preferably comprised between 1 millitorr and 1 atmosphere. With those values, the maximum power absorbed by the plasma still remains in excess of 80% of the power furnished.

Although the dimensions of the structure 3 are not critical in obtaining a satisfactory operation of the embodiment of the invention described in connection with FIGS. 1 to 4, it has been found that with the values $l_1$ and R which obey the equation:

$$2l_1 + 2R = \alpha\,(\lambda/2) + k\,(\lambda/2)$$

the best results could be obtained. In the formula above, R represents the radial distance separating the tubes 5 and 8, $\lambda$ is the mean excitation wavelength, $\alpha$ is a numerical coefficient comprised between 0.5 and 1 and $k$ is zero or a positive integer.

For the choice of the gas 1 it will be noted that the only condition needed is that it not attack the material from which the tube 2 is made. It is possible therefore to choose for example oxygen or chlorine. By way of examples, again, and an the inventors' expriments have shown, it is possible to use range gases, nitrogen, sulpur hexafluoride $SF_6$ or hydrocanic acid CHH.

As already mentioned, the frequency $f_o$ of the energising signal is advantageously at least equal to 100 MHz. During the course of the experiments conducted within the framework of the invention, the maximum energising frequency for the devices shown in FIGS. 1 to 4 was 2,450 MHz. However, this value does not constitute a limit.

With regard to the length of the plasma created by means of the energising device shown in FIGS. 1 to 4, it will be seen in FIG. 8 that this varies in a substantially linear way as a function of the absorbed power and on a basis of course of a threshold value $P_s$ of this power. Shown in watts in the abscissa of this FIG. 8 is the power $P_2$ absorbed by the plasma while the ordination represent in cm the length $L_1$ of this plasma.

The diagram in FIG. 8 corresponds to the following experimental conditions. The gas contained in the tube 2 was argon, the frequency $f_o$ of the energising signal was 460 MHz, the tube 2 was of glass with an inside diameter of 25.4 mm and an outside diameter of 29.8 mm, the plate 14 was substantially in the form of a square measuring 1.27 cm by 1.27 cm, the thickness $e$ was 0.5 mm and the gap 5a was of 2 mm. The points having the form of a circle correspond to experiments where the argon pressure was 40 millitorrs; the experimental points shown by squares correspond to pressures of 150 millitorrs and the points by triangles correspond to experiments for the argon pressure with 1.5 Torr.

With the graph 80, it can be seen that the length $L_1$ of the plasma created varies indeed in substantially linear fashion as a function of the absorbed power, at least if this power is less than 80 watts (while being greater than the threshold value). For the various experiments conducted, it was found that the slope of the straight line 80 was 1.85 cm per watt.

It is stated eariler that the creation of the plasma by means of the device according to the invention resulted from the propagation of a surface wave. The assembly shown in FIG. 9 makes it possible to demonstrate the propagation of such surface waves in the plasma created. The results obtained with this assembly are represented by the diagrams in FIGS. 10 and 11.

In the assembly shown in FIG. 9, the assembly 3 is of the type shown in FIGS. 1 to 3. After the gap 5*a*, it is immediately followed by a resonant cavity 102 which has the same purpose as the cavity 52 in the assembly shown in FIG. 5. In other words, the cavity 102 makes it possible to determine the electronic density of the plasma by observing the frequency change of the resonance peak of this cavity in the mode $TM_{010}$. In order to determine the said electronic density, it is assumed that the plasma is a dielectric of relative permittivity $\epsilon_g = 1 - (f_{pe}^2/f_o^2)$.

In the example, the wall 11 of the assembly 3 constitutes likewise a wall of the said resonant cavity 102. This latter disposition whereby a wall common to the resonant cavity 102 and the assembly 3 makes it possible to a great extent to diminish the reflections and therefore the attenuation of the surface wave, one plane of reflection being eliminated. Likewise in order to reduce the reflections of the surface wave, the second transverse wall 103 of the cavity 102 comprises an opening 104, the diameter of which is substantially greater (by a factor 2 in the example than the outside diamter of the tube 2. Still with the same object —to reduce the attenuation of the surface wave — the axial dimension of the cavity 102, that is to say the distance separating the walls 11 and 103 is less than the wavelength of the surface wave. With this latter arrangement, it is possible to obtain a measurement of the density of the plasma which is local and not a mean value.

The wavelength of the wave which is being propagated in the plasma 2 is determined by displacing a movable antenna 105 carried by a trolley or carriage 106 along the said tube 2. The antenna 105 makes possible to determine the variations of the phase $\phi$ of the above-mentioned wave as a function of its axial position. As will be seen hereinafter, the assembly illustrated in FIG. 9 makes it possible to determine a value proportional to the quantity $\cos [\phi_R - \phi(x)]$, $\phi_R$ being a constant. Thus it is possible to determine the wavelength on condition that the stationary wave rate of this wave is low.

In order to carry out the above-mentioned measurements, the output from the antenna 105 is connected to the input of a coupler-divider 10. of valve 3 describes in the example. The first output of this coupler 107 is connected to the input of another directive coupler 108. A second output of the coupler 107 is connected to the input of an attenuator 103 of variable ratio, the output of which is connected to the first input of a mixer 110.

The main output (with no attenuation) of the coupler 108 is connected to the input of a device 111 at the output of which there appears an analogue signal representing the value $A^2(x) \cos^2\phi_o$ This device 111 is therefore a quadratic value detector. $A(x)$ represents the amplitude of the signal obtained at the output of the antenna 105.$\phi_o$, which is independent of x, is the phase shift of the signal $A(x)$, this phase shift being determined by the presence in particular of the couplers 107 and 108.

The output of the device 111 is connected to the input Y of a first recorder 112.

A signal representing the quantity $A(x)$ appears at the second output (of attenuation − 30 decibels) of the directive coupler 108. This second output is connected to the input of an amplitude detector device 113 which at its output supplies a signal representing the quantity $A(x) \cos \phi_o$. The output of the device 113 is connected to the "divider" input of an analogue divider 114, the output of which is connected to the input Y of a second recorder 115.

In order to supply the metal plate 14 of the assembly 3, an HF generator 116 of variable frequency (of 500 to 1000 NHz in the example) is provided. The output of this generator 116 is connected to the acid plate 14 through the intermediary of a directive coupler 117 and an isolator 118 in series. At the second output of the coupler 117 appears an attenuated signal of − 35 decibels with respect to the output signal from the generator 116. This second output is connected to the input of phase shifter 119, the output of which is connected to the second input of the mixer 110. The output signal of the said mixer 110 represents the quantity:

$$A(X) \text{ R} \cos [\phi_R - \phi_{(X)}]$$

$\phi_R$ represents the phase shift of constant value introduced by the phase shifter 119 and R is a constant.

The output of the mixer 110 is connected to the "numerator" input of the divider 114 through a low pass filter 120. The cut-off frequency of the filter 120 is 1 Magehertz in the example.

At the output of the divider 144 appears a signal of value:

$$\frac{C\,A(x)\,R \cos [\phi_R - \phi(x)]}{A(x) \cos \phi_o}$$

In this formula C is the gain of the analogue divider 114.

It will be seen therefore that the divider 114 makes it possible to be independent of any variations in the amplitude of the signal $A(X)$.

Potentiometer means (not shown) make it possible to generator a signal representing the position x of the antenna along the tube 2. The output of these voltmeter means is connected to the input X of recorders 112 and 115.

Thus, the recorder 115 makes it possible to measure the variations in the above mentioned quantity $\cos [\phi_R - \phi(x)]$as a function of the variable $x$ and therefore the wavelength of the wave detected by the antenna 105.

On the other hand, the recorder 112 makes it possible to measure the variations in amplitude of the wave detected by the antenna.

The curves of the diagram shown in FIG. 11 were obtained by means of the recorder 115. In this diagram, the abscissa represents the quantity $x$ expressed in centimetres (the origin is on the right), while the ordinates show quantities proportional to the value $\cos [\phi_R - \phi(x)]$.

The curves in the diagram in FIG. 11 were obtained under the following experimental conditions. The energising frequency $f_o$ was 700 MHz. The gas contained in the tube 2 was argon. The tube 2 was of "Pyrex" glass with an inside diameter of 25 mm and an outside diameter of 30 mm and its relative permittivity $\epsilon_g$ was equal to 4.52. The axial length of the assembly 3 was 7 cm and the outside diameter 10 cm, the gap 5a being 2 mm wide.

Finally, the axial length of the cavity 103 and 4 cm and its diameter 15.5 cm.

The curves 120, 121 and 122 correspond to the ratio $f_o/f_{pe}$ having values of respectively 0.181, 0.154 and 0.126. Examination of these curves 120, 121 and 122 reveals that the wavelength of the wave detected along the tube 2 decreases as one moves away from the structure 3.

Shown on the abscissa in the diagram in FIG. 10 is the quantity *ka, k* being the wave number:

$$k\ (\mathrm{cm}^{-1}) = 2\pi/\lambda$$

and a being the interior radius of the tube 2. The quantity *ka* is therefore a number of no dimension.

The ratios $f_o/f_{pe}$ are shown in the ordinates.

The curve showing the variation of $f_o/f_{pe}$ as a function of ka is called the dispersion curve. The solid line curve 125 corresponds to the (theoretical) curve of dispersion of a surface wave of azimuthal symmetry ($m = 0$). The (circular) points 126 correspond to experimental measurements carried out under the following conditions. The energising frequency $f_o$ was 500 MHz. The structure 3 corresponded to that used in order to draw up the chart in FIG. 11. The various experimental points of the diagram in FIG. 10 corresponded to the following pressures: 2, 5, 10, 40, 70, 150 and 200 millitorrs. These experimental points 126 are distributed over a curve having the same form as the theoretical curve 125. It is therefore indeed a surface wave which is involved. However, the divergence between the experimental measurements and the theoretical curve 125 corresponds at least in part to the fact that the theoretical curve 125 was established on the assumption that the density of the plasma is constant in a radial direction, this hypothesis probably corresponding to an approximation, at least at low pressures.

Finally, it will be noted that the assembly in FIG. 9 has likewise made it possible to show that at the end of the plasma created there was: $fo = f_{pe}/\sqrt{1 + \epsilon_g}$. This finding is yet another confirmation of the fact that the plasma is generated by the propagation of a surface wave.

Now, in conjunction with FIGS. 12 and 13, another form of embodiment of the energising device according to the invention will be described.

In this embodiment, as in the embodiments illustrated in FIGS. 1 to 4; it is necessary for the power furnished to the energising structure to exceed a minimum threshold. In the same way as in the other embodiments, the plasma energising structure furnishes an electrical field at the level of this structure which is parallel with the axis of the gas column. Of course, as in the other cases when the threshold value of the power is exceeded, the plasma generated extends over a length which is substantially greater than that occupied by the energising structure in the direction of the column of gas.

The energising structure shown in FIG. 12 and 13 does however have the advantage of being able to function with excitation frequencies $f_o$ in excess of those which can be used for the above described structure. Furthermore, the power furnished may be substantially greater in view of the fact that, in the structure which is going to be described, no coaxial cable is used inside the energising structure.

The energising structure shown in FIG. 12 comprises a wave guide 130 of rectangular cross-section. The walls 131 and 132 associated with the long sides off the cross-section comprise a circular opening 133 intended to allow passage of the glass tube 2' containing the column of gas to be energised.

In the example, the wave guide 130 has the transverse dimensions of a guide intended for the band S (2,080 to 3,950 MHz). The rectangular cross-section therefore has a width of 3.41 cm and a length of 7.21 cm. It will immediately be noted that in such a rectangular wave guide, in the fundamental mode, the electrical field is perpendicular to the long side as shown by the arrows 134 in FIG. 12.

On the side of the first end of the guide 130 there is a transition element 135 allowing the guide 130 to be fed by a coaxial cable (not shown) connected to an HF generator, likewise not shown.

Installed at the other end of the wave guide 130 is an adapting piston 136 rigid with a rod 137 which makes it possible to have the said piston slide over a stroke of length L. This length L is preferably of the order of the size of the wavelength $\epsilon_g$ of the fundamental mode of the guide 130.

Beyond the travel L, the wave guide 130 extends over a length $L_1$ in the middle of which is the opening 133. In the example, this length $L_1$ is worth about 10 to 15 times the radius of the tube 2'. Indeed, this length $L_1$ must not be too small in order to avoid reflections in the guide, reflections which would affect the homogeneity of th plasma created in the column 2'. Furthermore, with a sufficiently considerable length $L_1$, the azimuthal symmetry of the electrical field will be respected.

Of course, the piston 136 has an adapting role which permits of maximum absorption by the gas column of the HF energy furnished by the generator.

In the vicinity of the openings 133, the walls 131 and 132 are of a small thickness of the order of 0.25 mm in the example. In this way, the electrical field of the surface wave in the plasma is not greatly attenuated at the output of the wave guide.

As can be seen in FIG. 13, in the wave guide 130 in the vicinity of the opening 133 and against the wall 131 there are installed metallic corners 140. In this way, the length $L_2$ over which the electrical energising field is exerted in the wave guide, is reduced, so that this length $L_2$ is always less than the wavelength of the surface wave created. This wavelength of the surface wave is of the order of 5 cm for an energising power of 50 watts in the example.

Although in the embodiment described, the wave guide 130 has dimensions which make it possible to operate in the band S, the invention is not limited to these dimensions. For example, it would be possible to choose dimensions for the guide 130 which would enable it to operate in the band X (10 GHz).

FIGS. 14 and 15 are diagrams, the graphs in which illustrate the properties of the wave guide energising structure shown in FIGS. 12 and 13 and also the characteristic features of the plasma created with this structure.

Shown on the abscissa in FIG. 14 is the position p of the piston in centimetres. The origin corresponds to the position in which the said piston 136 is closest to the tube 2'. On the axis of the ordinates is shown on the left, the power absorption (expressed as a %) of the energising device shown in FIGS. 12 and 13. On the righthand side, the graduations on the ordinates correspond to lengths of plasma created, expressed in centimetres.

The solid line graph 142 represents the percentage variations in the power absorbed by the structure illustrated in FIG. 12 as a function of the position of the piston 136. The broke-line graph 143 shows the variations in the length of the plasma created in the tube 2' likewise as a function of the position *p* of the piston 136.

The graphs in FIG. 14 were obtained under the following experimental conditions. The dimensions of the wave guide correspond to those already indicated (band S). The diameter of the tube 2' was 15 mm and the gas to the energised was argon at 150 millitorrs pressure. The incident power (power furnished by the HF generator) was 50 watts and the energising frequency 2,450 MHz. The walls 131 and 132 in the vicinity of the openings 133 were thinned down to 0.25 mm.

Under the experimental conditions set forth hereinabove, it will be seen that virtually total absorption can be obtained for a specific position of the piston 136. It should likewise be noted that for this specific position the length of plasma shows a pronounced maximum. It will however be noted that when the walls 131 and 132 are not thinned in the vicinity of the opening 133, the maximum plasma length does not correspond to the maximum absorption in the structure.

Shown on the abscissa in the charts in FIG. 15 is the power (expressed in watts) furnished by the HF generator while the ordinates on the left-hand side show the length of plasma created (in centimetres) and on the right-hand side the power absorbed (expressed as a %) in the energizing structure (FIG. 12).

The graph 144 shows in solid lines the variations in power absorbed by the energising structure as a function of the power furnished, while the broked line graph 145 illustrates the variations in length of plasma created according to the power provided.

The curves in FIG. 15 were drawn up with the wave guide of the size indicated earlier, the tube 2'was 15 mm in diameter, at the level of the openings 133 the wall thickness was 0.25 mm. The gas contained in the tube 2' was argon at a pressure of 300 millitorrs, the excitation frequency being 2.450 MHz.

As the graph 145 shows, it can be seen that the length of plasma created is a virtually linear function of the power absorbed, as in the case of the energising devices described in connection with FIGS. 1 to 4.

It should be noted that, during the course of the experiments conducted within the framework of the invention (energising frequency 2,450 MHz the gas being argon), the inventors found that the power absorption decreases as a function of the pressure, at least in the range of 100 millitorrs to 10 torrs. The electronic densities measured were of the order of $5.10^{11}$ to $5.10^{12}$ electrons per cubic centimetre.

The above-mentioned experiments make it possible to think that as in the case of the device shown in FIGS. 1 to 4, the plasma is created owing to the propagation of a surface wave, the wavelength of which is comprised between 4.5 and 6 cm for a furnished power of 50 watts.

In the embodiment shown in FIG. 12, the power furnished to the wave guid 130 is carried by an element 135 ensuring the transition between a coaxial cable and the wave guide. However, for high powers the HF energy may be carried directly by another wave guide.

As already indicated above, in order to be able to create a plasma emerging from the energising structure whatever the form of embodiment of the invention, it is necessary for the power furnished to the energising device to exceed a minimum threshold. A few examples of such threshold values $P_s$ will be given below.

In the case of a structure of the type described in conjunction with FIGS. 1 to 3 with an energising frequency $f_o$ of 460 MHz and a glass tube having an inside diameter of 25 mm, the gas being argon, the table below gives the values of $P_s$ for certain values of the pressure:

| Pressure (Torr) | $10^{-2}$ | $10^{-1}$ | 1 | 10 |
|---|---|---|---|---|
| $P_s$ (watts) | 2.2 | 2.5 | 3.3 | 5 |

Under the same experimental conditions, for a pressure of 1 torr, the values of $P_s$ were 1.6, 2.2 and 3.3 watts for xenon, krypton and neon respectively.

The forms of embodiment of the invention which have been described in conjunction with the drawings may be the object of numerous variations.

By way of example of these variations, it will be indicated first of all that the glass tube may take the form of a closed tube. Likewise with regard to the glass tube, it may comprise an inner tube, for example a coaxial tube. The said inner tube may contain a gas adapted to be treated (with a view to analysis physical excitation, etc.) by the light created by the plasma.

It is not vital for the opening in the tube 5 (FIGS. 1 to 4) or the opening 133 to have a diameter which corresponds exactly to that of the tube 2 (or 2'). This diameter may be substantially greater. In this latter case, it is possible to dispose between the said openings and the tube means of heating or cooling the gas which is to be energised.

Although an essential advantage of the invention resides in the fact that it is possible to create a plasma of extended length without magnetic field generating means, it must however be noted that an axial magnetic field does not upset the operation of the energising device according to the invention. Moreover, the presence of such a magnetic field makes it possible to increase the efficiency of transfer of power of the energising device in view of the fact that in this way the probability of recombining ions at the level of the wall is diminished.

It will be noted that, in this latter case, where axial magnetic field generator means are provided, the plasma is generated by the propagation of the electrical field of a volume (and not a surface) wave. In this case, as in the others, it is necessary for the power furnished to be at least equal to a threshold value.

The plasma obtained with the device according to the invention is extremely calm; in other words, the rate of fluctuation of the electronic density as a function of the time is low. During the course of the experiments conducted within the framework of the invention, these relative variations did not exceed $10^{-4}$. Moreover, the parameters of this plasma are constant if the parameters of functioning of the device according to the invention are likewise constant; in other words, the plasma obtained is perfectly reproducible. It is thought that this last-mentionedproperty emanates from the fact that, with the energising devices constructed, only one single mode of operation is obtained.

With regard to the advantages of the device according to the invention, it will first of all be recalled that plasma columns of considerable length can be obtained with a device of small dimensions not necessarily comprising any independent means of creating a magnetic field. Furthermore, it is important to note that in the two forms of embodiment described, the adaptation of impedance is carried out without absorption of energy. In the case of the embodiments shows in FIGS. 1 to 4, the impedance of the energising device is regulated in an extremely simple way by the position of the plate 14.

It has been found that the light emitted by the plasma created with the device described had the same spectrum as the light emitted by a positive column formed by hot cathode discharge, of course on condition that the conditions are the same (nature of gas, pressure, diameter of the column and density).

The device according to the invention and the column 2 may therefore advantageously replace such a positive column; indeed, with this assembly, the HF energy serves solely to ionise the gas whereas in a positive column a considerable part of the voltage drop occurs in cathode and anode zones. Furthermore, no filament is used which might be likely to suffer damage and the range of operation, for pressure values, is extended.

Finally it should be noted that the column 2 may without disadvantage be replaced by a ring.

The applications of the energising device according to the invention are numerous. This device may be used as a device for energising a plasma in order to produce a spectral lamp. For this purpose, the length of the plasma is advantageously limited and the column 2 made from glass is closed at right-angles to its axis by a lens (not shown). Such a source of light has a considerable brilliance, it is stable, calm and reproducible. With the same structure, it is possible to produce a flash on a target located at the position of the lens. The device according to the invention may likewise be used in order to furnish the excitation of an ionic laser and/or in order to provide a source of ions. In particular, the device according to the invention makes it possible to produce excitation of a hydrofluoric acid laser emitting a radiation of wavelength 2.7$\mu$ and which may be of small size.

Among the applications of the device according to the invention it will be noted likewise that it is possible to produce a plasma on a column of gas of quite considerable length by installing several energising structures at distances along the column.

As it is possible in a relatively short and specific time (the gas ionisation time), to establish a conductor path between two electrodes, the result is that the plasma obtained with the device according to the invention may be used in order to prime a spark generator. Finally, as already mentioned, the device according to the invention makes it possible to create diffusion plasmas so long as means are provided to produce an axial magnetic field. In this case, the length of the plasma column is still further increased.

As goes without saying and as will arise mereover from the foregoing, the invention is in no way limited to those of its forms of embodiment and applications which have been more particularly envisaged; in contrast, it embraces all possible variations thereof. In particular, it is not essential for the tubes 5 and 8 (FIGS. 1 to 4) both to have the same shape; it is sufficient, for the tube 5 to enclose the casing 2 (even without contact).

We claim:

1. An excitation device for energizing a column of gas enclosed in an insulating casing of elongated form, said device comprising, in combination: generator means for generating a high frequency periodic electrical field having a frequency of at least 100 megahertz and supply means for supplying a signal of said frequency to the said generator means, said generator means comprising a plasma energizing structure adapted to be disposed on a part of the length of the said elongated casing, and constituting means for applying a said electrical field to the said column of a value such that, in the absence of a magnetic field, a plasma is generated over a certain length comprising the said part of the length of the elongated casing and an additional length which follows on from said part of the length.

2. Device according to claim 1, characterised in that the energising structure comprises means for generating surface waves in the said column, said surface waves having azimuthal symmetry with respect to the longitudinal axis of the casing.

3. Device according to claim 1, characterised in that the said structure comprises means for generating an electrical field extending in a longitudinal direction with respect to the said elongated casing.

4. Device according to claim 1, characterised in that the energizing structure comprises means for generating an electrical field of a transverse direction with respect to the elongated casing and means for orientating the said electrical field so as to produce from the transverse electrical field and at the periphery of the column an electrical field of a longitudinal direction with respect to the said casing.

5. Device according to claim 4, characterised in that the means for generating a transverse electrical field comprises a metal plate disposed facing the casing.

6. Device according to claim 5, characterised in that the means for orientating the electrical field comprises a metallic structure comprising a first tube, open at both ends and adapted to receive the said part of length of the casing, a second tube enclosing the first, and a connecting ring between the first ends of the first and second tubes, the second end of the second tube being closed by a transverse wall having an aperture therein for passage of the said casing, the second end of the first tube being separated from the said transverse wall by a gap, the said metal plate being disposed opposite the first tube in the space separating the said first and second tubes, the said supply means supplying said signal to the said metallic plate.

7. Device according to claim 6, characterised in that the supply means comprises a coaxial cable traversing an aperture provided in the second tube.

8. Device according to claim 6, characterised in that the first tube is of cylindrical form and in that the face of the said metal plate which is opposite said first tube comprises a segment of a cylinder of the same axis as the cylinder constituting the said first tube.

9. Device according to claim 6, characterised in that said device comprises first regulating means adapted to displace the metallic plate in the space separating the first and second tubes in order to vary the distance between said plate and the first tube.

10. Device according to claim 6, characterised in that said device comprises a second regulating means for displaying the said metal plate in the space separating the first from the second tubes so as to vary the distance separating the said plate from the said transversal wall.

11. Device according to claim 10, characterised in that the supply means comprises a rigid coaxial cable passing through an aperture provided in the second tube and in that this second tube comprises a slide adapted to slide in the direction of the length of the first tube, the said opening in the second tube being provided in said slide.

12. Device according to claim 6, characterised in that said device comprises an adapting conductor element a fraction of the volume of which is introduced into the space separating the first and second tubes, this fraction being capable of variation.

13. Device according to claim 6, characterised in that the part of the first tube which is opposite the said plate is covered by a coating of an insulating material.

14. Device according to claim 6, characterised in that the part of the said transverse wall which is opposite a portion of the said plate is covered with a layer of an insulating material.

15. Device according to claim 6, characterised in that the thickness of the said transverse groove is less than the thickness of each of the other parts of the said metallic enclosure.

16. Device according to claim 6, characterised in that the thickness of the said transverse wall is at most equal to 1 mm.

17. Device according to claim 6, characterised in that the length of the said gap separating the second end of the first tube from the said transverse wall is of the order of 2 mm.

18. Device according to claim 6, characterised in that the length of the second tube is at least equal to 5 cm.

19. Device according to claim 6, characterised in that the said metallic plate is disposed in the said space in the vicinity of the said gap and in the vicinity of the first tube.

20. Device according to claim 1, characterised in that the plasma energising structure comprises wave guide means.

21. Device according to claim 20, characterised in that the wave guide means comprise a wave guide of rectangular cross-section, the walls of this wave guide associated with the largest side of the said cross-section comprising apertures to allow passage of the said insulating casing, these walls being thin at least in the vicinity of the said apertures, and the thickness thereof being at most equal to 0.5 mm.

22. Device according to claim 20, characterised in that the wave guide means comprises a wave guide of rectangular cross-section, the walls associated with the largest side of the said cross-section comprising two facing openings for passage of the said insulating casing conductor corners being disposed in the vicinity of one of the said openings and of one of the said walls inside the wave guides around the insulating casing in order to reduce the length of gas to be energized which is subject to the electrical field located inside the wave guide.

23. Device according to claim 20, characterised in that the wave guide means comprises a wave guide having an end conductor wall and means of displacing said end wall.

24. An excitation device for energizing a column of gas contained in an insulating casing of elongated form, said device comprising in combination: generator means for generating a high frequency electrical field of a frequency of at least 100 megahertz, and supply means for supplying a signal of said frequency to the said generator means, said generator means comprising a plasma energizing structure disposed over a part of the length of the casing of elongated form, and constituting means for applying a said electrical field to the said column of a value sufficient to produce a plasma over a certain length comprising the said part of the length of the elongated casing and an additional length following on from the said part of said length, the said energizing structure comprising means for generating surface waves in the said column, said surface waves having azimuthal symmetry with respect to the longitudinal axis of the casing.

25. An excitation device for energizing a column of gas contained in an insulating casing of elongated form, said device comprising generator means for generating a high frequency electrical field of a frequency of at least 100 megahertz and supply means for supplying a signal of said frequency to the said generator means, said generator means comprising a metallic structure comprising a first tube, open at both ends and adapted to receive a fraction of the length of the insulating casing, a second tube enclosing the first tube, and a connecting ring between the first ends of the first and second tubes, the second end of the second tube being closed by a transverse wall having an aperture therein for passage of the elongated casing, the second end of the first tube being separated from the said transverse wall by a gap, the said structure further comprising a metal plate disposed opposite the first tube in the space separating the first and second tubes, the said supply means supplying the said signal to the said metallic plate, and the supply means comprising a coaxial cable extending through an opening provided in the second tube.

26. An excition device for energizing a column of gas contained in an insulating casing of elongated form, said device comprising generator means for generating a high frequency electrical field of a frequency of at least 100 megahertz, characterised in that said generator means comprises means for generating a surface wave in the said column.

27. Method of using periodic waves of a frequency of at least 100 Megahertz to energize a column of gas contained in an insulating casing of elongated form, wherein surface waves are created in said column by the generation of a high frequency electrical field of said frequency, the generation of the electrical field ensuring ionisation of the plasma.

* * * * *